US005107909A

United States Patent [19]

Donovan

[11] Patent Number: 5,107,909

[45] Date of Patent: Apr. 28, 1992

[54] RETRACTABLE, SELF-VENTILATING, SELF-STOPPING POURING SPOUT

[76] Inventor: Terrence E. Donovan, 701 W. Galena, Apt. #3, Butte, Mont. 59701

[21] Appl. No.: 650,175

[22] Filed: Feb. 4, 1991

[51] Int. Cl.[5] ..... B67C 3/00; B67D 3/00

[52] U.S. Cl. ..... 141/296; 141/198; 141/288; 141/353; 222/484; 222/518; 222/538

[58] Field of Search ..... 222/484, 538, 478, 479, 222/481, 481.5, 482, 518, 526, 535; 141/198, 353, 335, 39, 202, 288, 291, 292, 293, 295, 296

[56] References Cited

U.S. PATENT DOCUMENTS

| | | | |
|---|---|---|---|
| 14,229 | 2/1856 | Enos | 222/484 |
| 525,744 | 9/1894 | Roth | 141/292 |
| 1,237,773 | 8/1917 | Gamble | 222/484 X |
| 2,440,112 | 4/1948 | Nellson | 222/484 |
| 2,445,130 | 7/1948 | Turner | 222/484 X |
| 2,841,313 | 7/1958 | Beall, Jr. | 222/484 X |
| 3,074,444 | 1/1963 | Hawksford | 141/353 |
| 3,173,587 | 3/1965 | Stearns | 222/538 X |
| 3,221,935 | 12/1965 | Shurtleff et al. | 222/538 X |
| 3,934,760 | 1/1976 | Le Gresley | 222/538 X |
| 4,650,096 | 3/1987 | Thatcher | 222/538 X |
| 4,687,122 | 8/1987 | Bothun et al. | 222/484 X |
| 4,834,151 | 5/1989 | Law | 141/296 X |
| 4,924,921 | 5/1990 | Simmel et al. | 141/295 X |
| 4,958,668 | 9/1990 | Vachon | 141/352 X |

*Primary Examiner*—Kevin P. Shaver
*Attorney, Agent, or Firm*—Richard C. Conover

[57] ABSTRACT

A pouring spout assembly removeably fitted inside the mouth of a supply container includes an elongate spout for pouring liquid from the supply container to the target container through a spout exit opening. This spout further includes a tubular vent extending from the interior of the supply container to a vent opening adjacent the spout exit opening. A cap is threaded on to the mouth of the supply container and provides an air tight seal between the inside of the supply container to the atmosphere. A valve is provided, which valve is resiliently biased to a normally closed position to prevent fluid flow through the spout and to prevent air from being drawn through the vent. Structure is provided so that a user may manually open the valve by the act of inserting the spout into the target container.

6 Claims, 2 Drawing Sheets

RETRACTABLE, SELF-VENTILATING, SELF-STOPPING POURING SPOUT

BACKGROUND OF THE INVENTION

This invention pertains to a retractable, self-ventilating, self-stopping pouring spout assembly for use when pouring liquid from a supply container to a target container. The spout assembly is of the type where liquid flow is automatically stopped when the fluid level in the target container reaches a desired level.

With pouring spouts, several problems can occur when transferring liquid from a supply container to a target container. Once the supply container is tipped to begin the transfer, liquid tends to surge down the spout, often reaching the spout exit opening before the spout tip is safely inside the target container. If the liquid is flammable or toxic, a dangerous spill can occur at the time liquid is just starting to be transferee. If high temperature sources are nearby, such as a chain saw or a lawn mower, the spill can become a significant safety hazard at the time the liquid is being transferee.

Furthermore, as the target container becomes full, conventional spout must be tilted rapidly upright to raise the exit opening of the spout above the liquid level in the supply container, for otherwise, an additional spill would occur through the pouring spout.

Spout assemblies are known which stop the liquid flow once the surface of the liquid in the target container rises above a predetermined level. These spout assemblies typically have a elongate vent that extends from the supply container into a target container. When the fluid level in the target container reaches an air intake opening in the vent, flow is stopped. For example see U.S. Pat. No. 4,588,111 to Hestehave. As the liquid rises above the air intake opening in the vent, suction is created in the supply container which stops the flow of additional liquid.

Spout assemblies typified by the Hestehave spout do not solve the problem of preventing spillage when the spout connected to the supply container is initially tilted into the target container, nor do these assemblies solve the problem of preventing spillage when the vented spout is removed from the target container. When conventional spouts are lifted above the surface of the liquid in the target container, the suction in the supply container is broken and the liquid will resume flowing in the spout until the spout exit opening is raised above the surface level of the liquid in the supply container.

From the above it can be seen that a need exits for a spout assembly which can be placed in a target container with the flow of liquid through the spout initially stopped when the spout is inserted into the target container. Further a need exits for a spout assembly that prevents spillage when the spout assembly is lifted from the target container and tilted to an upright resting position.

SUMMARY OF THE INVENTION

The present invention provides for a pouring spout assembly removeably fitted inside a mouth of a supply container. The pouring spout assembly includes an elongate spout for pouring liquid from the supply container to the target container through a spout exit opening. This spout further includes a tubular vent extending from the interior of the supply container to a vent opening adjacent the spout exit opening. A collar is threaded onto the mouth of the supply container to hold the pouring spout assembly to the supply container. The collar also provides an airtight seal between the spout assembly and the supply container to prevent leakage of the fluid from the supply container during the pouring operation.

A valve is provided, which valve is resiliently biased to a normally closed position to prevent fluid flow through the spout and prevent air from being drawn through the vent. Structure is provided so that a user may manually open the valve by the act of inserting the spout into the target container. The structure opens the valve to permit fluid to flow through the spout and air to be drawn into the supply container through the vent.

The vent is provided with intake openings adjacent the spout access opening. After liquid in the target container is filled to the vent intake opening, the vent is closed to the air and further liquid flow is stopped by a partial vacuum developing in the supply container. As the spout assembly is removed from the target container, the valve is automatically released from its open position, and the valve which is resiliently biased to a normally closed position, moves to the closed position to stop additional liquid from flowing through the spout and air from being drawn through the vent into the supply container.

BRIEF DESCRIPTION OF THE DRAWINGS

In order that the invention may be clearly understood and readily carried into effect a preferred embodiment of the invention will now be described, by way of example only with reference to the accompanying drawings wherein.

DESCRIPTION OF A PREFERRED EMBODIMENT

Figure 1:
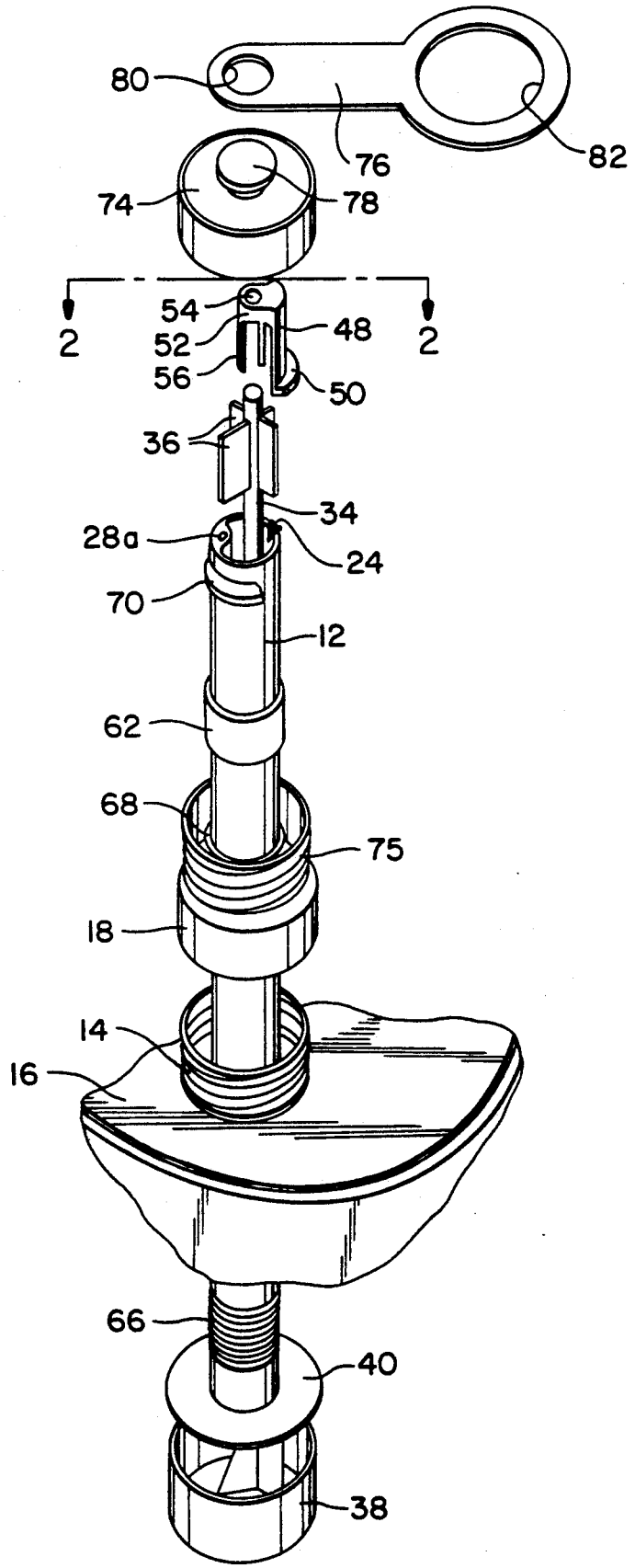
FIG. 1 is an exploded, perspective view of a pouring spout assembly according to the present invention showing the spout assembly positioned within the mouth of a supply container which container has been cut away for clarity.

With reference to the exploded view in FIG. 1, a pouring spout assembly 10 includes an elongate tubular spout 12 which is fitted in a threaded mouth 14 of a supply container 16. A collar 18 having interior threads 20 threadably engages exterior threads of threaded mouth 14 to attach spout assembly 10 to the supply container 16. Collar 24 is constructed, as will be described below, to provide an airtight seal between the spout 12 and the interior of mouth 14 when collar 24 is threaded onto mouth 14 to prevent leakage of the contents of the supply container during the pouring operation.

Figure 3:
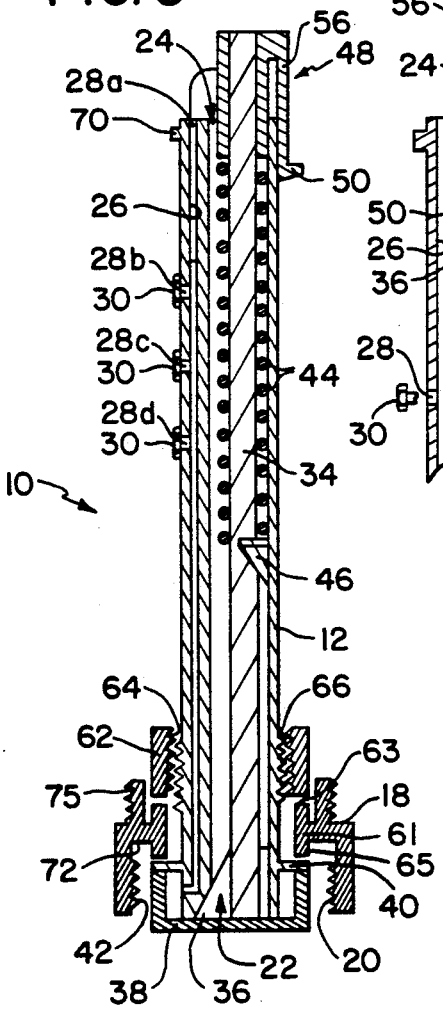
FIG. 3 is an unexploded sectional view of the pouring spout assembly taken along the line 3—3 of FIG. 2 with the valve in a valve closed position.
Figure 6:
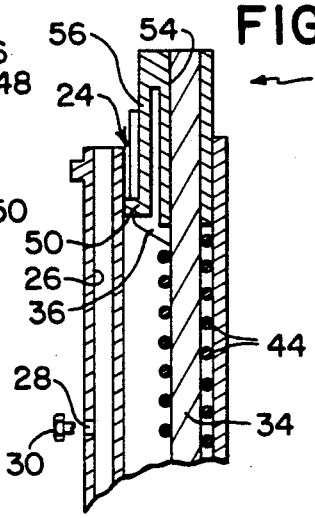
FIG. 6 is a partial sectional view of the top portion of the pouring spout assembly as shown in FIG. 3 with a valve actuating lip installed in an alternate position.

The spout 12 having an entrance opening 22 is used for pouring liquid from the supply container 16 into a target container (not shown) through a spout exit opening 24. The spout assembly 10 further includes a tubular vent 26 positioned in a wall of tubular spout 12 extending from adjacent the entrance opening 22 inside the supply container 16 to adjacent spout exit opening 24. Vent 26 provides a path for air to flow from adjacent the spout exit opening 24 into the interior of the supply container 16 to equalize the pressure between the inside and outside of the supply container 16 as liquid is removed. Vent 26 also has an end vent hole 28*a* and plurality of other vent holes 28*b*, 28*c* and 28*d* extending along the vent with each vent hole providing an aperture from the vent to the atmosphere. The vent holes 28*b*, 28*c* and 28*d* are fitted with removable plugs 30 as shown in FIGS. 3 and 6. The level of fluid in the target container, where fluid flow is automatically stopped, is selected by removing a particular plug 30. Fluid will flow until the fluid level in the target container reaches the unplugged vent hole and covers it.

Figure 4:
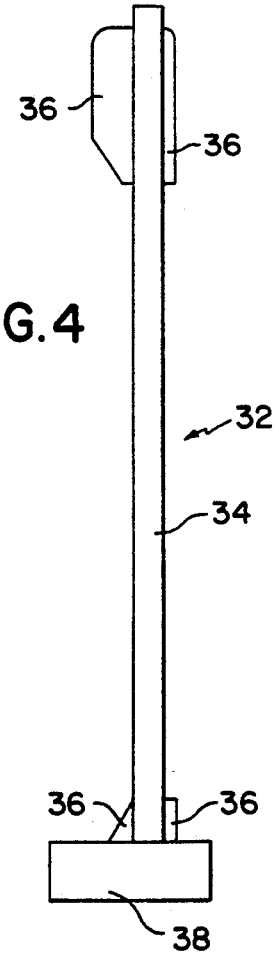
FIG. 4 is an elevational view of a valve and valve linkage used in the present invention.

A valve 32 as shown in FIG. 4 is used to open or close the fluid path through the spout 12. This valve includes a linking rod 34 which is slidably positioned in the interior of spout 12 as shown in FIGS. 1 and 3. Positioning vanes 36 are provided at both ends of rod 34 to maintain the spacing of rod 34 within the interior of spout 12. The rod 34 is secured at its bottom end thereof as shown in FIG. 4 in the interior of a hollowed out cup 38 as shown in FIG. 3. The cup 38 is sized to fit over and seal the entrance opening 22 of spout 10 as shown in FIG. 3 where the valve is shown in a valve closed position.

The spout 12 further includes a flange 40 as shown in FIG. 3 adjacent the bottom end of spout 12. The vent 26 includes a vent opening 42 located below the flange 40. A rim of cup 38 is sized to sealingly mate with the underside of flange 40 when the cup 38 is in the valve closed position as shown in FIG. 3. With this construction, the cup 38 also closes the vent opening 42 when the spout is closed.

When the cup 38 is moved downwardly from the position as shown in FIG. 3, the spout entrance opening 22 and the vent opening 42 are opened. The valve 32 is normally biased in a valve closed position with a compression spring 44. The compression spring 44 rests on a spring landing 46 secured to an interior wall of spout 12 as shown in FIG. 3. The upper end of spring 34 rests against the upper positioning vanes 36 as shown in FIG. 6. With the compression spring in this position, the rod 34 is resiliently and normally biased in an upward position such that cup 38 closes entrance opening 22 and vent opening 42. When, however, the rod 34 is moved downwardly from the position as shown in FIG. 3, the cup 38 is moved away from spout entrance opening 22 and the vent opening 42.

Figure 2:
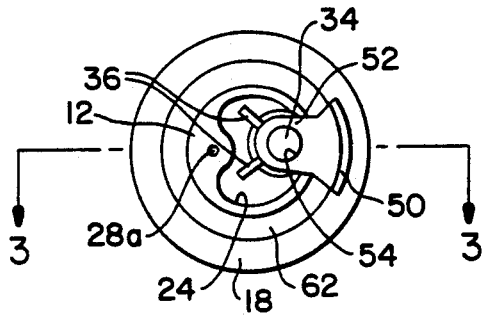
FIG. 2 is a top plan view of the pouring spout assembly as seen from the line 2—2 in FIG. 1.
Figure 5:
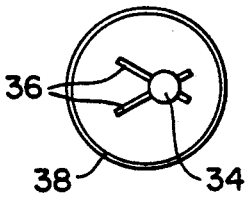
FIG. 5 is a top view of the valve and valve linkage shown in FIG. 4.
Figure 7:
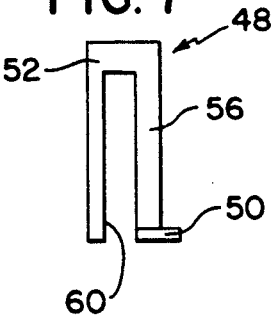
FIG. 7 is an elevational view of a hook assembly used with the present invention and shown in FIG. 1.

In a preferred embodiment of the present invention, a hook assembly 48 (as shown in FIG. 7) is attached to rod 34 as shown in FIGS. 2, 3 and 6. The hook assembly 48 includes a generally cylindrically shaped body 52 which has a bore 54 (shown in FIG. 2) extending there through for frictionally receiving an end of rod 34 as shown in FIG. 3. Hook assembly 48 can be removed from rod 34 by pulling hook assembly off rod 34. Hook assembly 48 has portions broken away as at 60 as shown in FIG. 7 so as not to interfere with positioning vanes 36 when hook assembly 48 is secured to rod 34. Further, hook assembly 48 is sized so that when it is positioned on rod 34, it does not completely close the spout exit opening 24 of spout 12 as shown in FIG. 2 so that when fluid flows out of spout 12, there is sufficient space for the fluid to exit the spout around hook assembly 48. The hook assembly 48 has a spaced apart depending leg portion 56 spaced apart from the cylindrical body 52. The space provided between body 52 and leg 56 is sized to provide a gap for receiving a side wall of spout 12 as shown in FIG. 3. A protruding hook 50 is integrally formed on leg 56 as shown in FIGS. 1 and 3.

In the valve closed position as shown in FIG. 3 the rod 34 with hook assembly 48 extend beyond the spout exit opening 24. The hook 50 is positioned to be below spout exit opening 24 also as shown in FIG. 3. The hook 50 is used to engage the lip of the mouth of the target container so that when the spout 12 is pushed further into the mouth of the target container, the hook 50 connected to rod 34 pushes the rod downwardly as shown in FIG. 3 thus opening the spout entrance opening 22 and vent opening 42.

Since the vent opening 28*a* is positioned within the interior of the target container, fluid will flow through the spout 12 until the fluid level reaches the vent opening 28*a* whereupon fluid flow is stopped. If a different level in the target container is desired, the hook 50 is not used to engage the lip of the target container. Instead the spout 12 is pushed into the target container and against the bottom of the interior of the target container. The level desired is selected by removing the appropriate plug 30 from a vent hole 28*b*, 28*c*, or 28*d*. By pushing the rod downwardly from the position shown in FIG. 3 the spout is opened and the vent is opened and fluid flows through spout 12 until the fluid level reaches the particular vent hole where the vent plug 30 was removed.

Spout 12 is held on container 16 with the collar 18. The collar 18 has an outer wall with interior threads 20 positioned in concentrically spaced apart relation from the cup 38 when cup 38 is in the valve closed position as shown in FIG. 3. The space provided between threads 40 and the wall of cup 38 is provided so that the mouth 14 of the supply container 16 can fit in the space provided. The upper lip of the mouth of 14 rests against a land 72 to seal the mouth 14 when the collar 18 is screwed onto threads of mouth 14.

To hold the spout 12 in an extended position relative to collar 18, a locking ring 62 as shown in FIGS. 1 and 3 is provided. This locking ring 62 has interior threads 64 for threadably engaging exterior threads 66 provided o the spout 12 as shown in FIG. 3. The collar 18 is provided with an interior "T" shaped flange 61 as shown in FIG. 3, the flange 61 having an upper locking surface 63 and a lower sealing surface 65. As the locking ring 62 is threaded on threads 64, spout 12 is drawn upwardly as shown if FIG. 3 until the locking ring engages locking surface 63. Flange 40 of spout 12 is also drawn tight against sealing surface 65 to seal the contents of supply container 16 from leaking out of container 16 around spout 12.

The spout 12 may be retracted into the interior of the supply container 16 by unthreading locking ring 62 from threads 66. The locking ring slips upwardly on spout 12 and spout 12 drops into the interior of supply container 16. The locking ring slides upwardly on the spout 12 until the locking ring engages a stop 70 provided at the upper end of spout 12 as shown in FIG. 3, with the locking ring as sandwiched between stop 70 and locking surface 63, spout 12 is prevented from moving further downwardly into the supply container 16.

In order that the hook 50 does not interfere with the retraction of spout 12 into the supply container 16 when the hook 50 is positioned as shown in FIG. 3, the hook assembly 48 is first removed from the rod 34 and rotated 180 degrees from the position shown in FIG. 3 to the position shown in FIG. 6. Now the hook 50 is located inside the spout 12 and does not interfere with the retraction of spout 12 into the interior of the supply container 16.

Once the spout 12 is retracted inside the supply container 16 a closure cap 74 is threaded on exterior threads 75 provided on collar 18 as shown in FIG. 1. To prevent the closure cap 74 from being lost when the spout is being used a tether 76 mounted to a tether post 78 provided on closure cap 74 with tether ring 80 is used. The tether 76 has a larger tether ring 82 for fitting over mouth 14 for securing the tether 76 to mouth 16.

In operation, when it is desired to pour a liquid from a supply container 16 to a target container, the closure cap 74 is removed from collar 18 and allowed to remain free on tether 76. The spout 12 is then extended from the supply container and locking ring 62 threaded onto threads 66 of spout 12, this prevents spout 12 from dropping again into the supply container 16 during use and seals the contents of supply container 16 from leaking out around spout 12. If hook 50 is desired to be used, the hook assembly 48 is removed from rod 34 and rotated 180 degrees to the position shown in FIG. 3 with the hook 50 protruding outside the spout 12. This places the hook 50 in the position to catch the lip of the mouth of the target container.

The spout is used to pour liquid from the supply container 14 into the target container by lifting the spout assembly 10 over the target container with the hook 50 engaging the lip of the mouth of the target container. Liquid is prevented initially from flowing through the spout 12 by cup 38 which is resiliently held in a position to close the entrance opening 22 of the spout 12 and also the vent opening 42 of vent 26. When the hook 50 is pushed against the lip of the mouth of the target container, the rod 34 moves downwardly as shown in FIG. 3 thereby opening entrance opening 22 and vent opening 42 to permit liquid to flow into the target container. Air and fumes from the target container will flow through the vent 34 into supply container 14 to equalize the pressure inside and outside the supply container. When the liquid level in the target container rises above the vent opening 28*a* the vent is blocked. This causes a vacuum in the supply container 16 which soon stops the flow of liquid in the spout 12 and prevents overflowing of the target container. The spout assembly 10 can then be removed from the mouth of the target container. As pressure is released from hook 50 acting against the lip of the mouth of the target container the cup 38 being biased with compression spring 44 moves to the closed position as shown in FIG. 3. The small amount of fuel remaining in the spout 12 will drain into the target container but further transfer of liquid is prevented by the cup 38 closing the entrance to spout 12 and also the vent 26. As the spout 12 is then lifted from the target container further fluid flow is prevented from flowing out of the spout 12 by cup 38.

If hook 50 is not to be used or if a different fluid level in the target container is desired, an appropriate plug 30 is removed from the corresponding vent hold and the spout 12 inserted into the target container until the end of rod 34 reaches the bottom of the target container. When the rod 34 is pushed against the bottom, fluid will begin to flow through spout 12 unit the fluid level reaches the open vent hole. Then fluid flow will stop. As the spout 12 is removed from the target container spring 44 causes cup 38 to move to the valve closed position thus avoiding spillage as the spout 12 is removed from the target container.

After use of the spout assembly 12, spout 12 may be retracted into supply container 16 as described previously for storage.

While the fundamental novel features of the invention have been shown and described, it should be understood that various substitutions, modifications and variations may be made by those skilled in the art without departing from the sphere or scope of the invention. Accordingly all such modifications or variations are included in the scope of the invention as defined by the following claims.

I claim:

1. A pouring spout for pouring liquid from a supply container having a mouth to a target container comprising:

a tubular spout extending from inside the supply container outwardly through the mouth, the tubular spout having a spout entrance opening positioned inside the supply container and spout exit opening for positioning inside the target container;

a tubular vent extending generally beside and along the spout, and extending from inside the supply container outwardly through the mouth, the vent having a supply container opening positioned inside the supply container and an air intake opening for positioning inside the target container;

a cap means for sealing to the atmosphere the mouth of the supply container with the tubular spout and vent extending therethrough;

a valve means for closing the tubular spout and tubular vent, the valve means being moveable from an open position to a closed position;

resilient means for normally biasing the valve means to the closed position; and a moving means for manually moving the valve to the open position against the bias force of the resilient means, the moving means further including a linking rod connected to the valve means, the linking rod extending generally along the tubular spout and sized to extend beyond the spout exit opening, whereby the valve means may be moved from the valve closed position to the valve open position by correspondingly moving the rod;

the moving means further including an outwardly protruding hook means attached to the linking rod for engaging a lip of a mouth of the target container when the spout is pushed into the target container and for moving the rod and valve means against the bias force of the resilient means when the spout is further pushed into the target container to move the valve means to the valve open position.

2. The spout assembly according to claim 1 wherein the tubular vent includes multiple vent openings along the tubular vent and removable plugs for insertion into the vent openings whereby the level of fluid in the target container can be selected by removing the appropriate plug.

3. A pouring spout for pouring liquid from a supply container having a mouth to a target container comprising:

a tubular spout extending from inside the supply container outwardly through the mouth, the tubular spout having a spout entrance opening positioned inside the supply container and a spout exit opening for positioning inside the target container;

the tubular spout further having an externally extending flange for positioning inside the supply container;

a tubular vent included in a wall of the tubular spout and extending generally beside and along the spout and extending from inside the supply container outwardly through the mouth, the vent having a supply container opening positioned inside the supply container and an air intake opening for positioning inside the target container;

a cap means for sealing to the atmosphere the mouth of the supply container with the tubular spout and vent extending therethrough;

a valve means for closing the tubular spout and tubular vent, the valve means being moveable from an open position to a closed position;

the valve means further including a cup having a rim which closes the tubular spout and tubular vent when the rim is moved into sealing engagement with the flange and opens the tubular spout and tubular vent when the rim is moved away from the flange;

resilient means for normally biasing the valve means to the closed position; and a moving means for manually moving the valve to the open position against the bias force of the resilient means.

4. The spout assembly according to claim 3 wherein the tubular vent includes multiple vent openings along the tubular vent and removable plugs for insertion into the vent openings whereby the level of fluid in the target container can be selected by removing the appropriate plug.

5. The spout assembly according to claim 3 wherein the means for manually moving the valve to the open position includes a linking rod connected to the cup, the linking rod extending generally along the tubular spout and sized to extend beyond the spout exit opening, whereby the cup may be moved from the valve closed position to the valve open position by correspondingly moving the rod.

6. The spout assembly according to claim 5 further including an outwardly protruding hook means attached to the linking rod for engaging a lip of a mouth of the target container when the spout is pushed into the target container and for moving the rod and cup against the bias force of the resilient means when the spout is further pushed into the target container to move the cup to the valve open position.

* * * * *